US006640510B2

(12) United States Patent
Kane

(10) Patent No.: US 6,640,510 B2
(45) Date of Patent: Nov. 4, 2003

(54) DECORATIVE STAINED GLASS AND METHOD

(76) Inventor: Robert Kane, 1905 Romeo Rd., Leonard, MI (US) 48367

( * ) Notice: Subject to any disclaimer, the term of this patent is extended or adjusted under 35 U.S.C. 154(b) by 0 days.

(21) Appl. No.: 10/139,726

(22) Filed: May 6, 2002

(65) Prior Publication Data

US 2002/0162288 A1 Nov. 7, 2002

Related U.S. Application Data

(60) Provisional application No. 60/288,962, filed on May 4, 2001.

(51) Int. Cl.[7] ..... E06B 3/66
(52) U.S. Cl. ..... 52/204.59
(58) Field of Search ..... 52/204.59, 311.2, 52/786.11, 745.19, 745.15

(56) References Cited

U.S. PATENT DOCUMENTS 4,619,850 A * 10/1986 Charlton ..... 428/38
4,756,938 A * 7/1988 Hickman ..... 428/38
4,791,762 A * 12/1988 Hwang ..... 52/171.3
5,039,468 A * 8/1991 Sellers ..... 264/225
5,134,004 A * 7/1992 Moline ..... 428/38
5,160,566 A * 11/1992 Ashby et al. ..... 156/252
5,282,504 A * 2/1994 Anderson et al. ..... 160/107
5,283,995 A * 2/1994 Richter ..... 52/202
5,352,532 A 10/1994 Kline
5,411,780 A 5/1995 Kaefer
5,494,715 A 2/1996 Glover
5,497,588 A * 3/1996 Martin et al. ..... 52/208
5,501,888 A * 3/1996 Hanson et al. ..... 428/38
5,753,341 A * 5/1998 Peng ..... 428/122
6,042,912 A * 3/2000 Simoni ..... 428/38
6,272,801 B1 8/2001 Suh
2002/0066250 A1 * 6/2002 Plager ..... 52/311.1

* cited by examiner

*Primary Examiner*—Kimberly Wood
*Assistant Examiner*—Kofi Schulterbrandt
(74) *Attorney, Agent, or Firm*—Warn, Burgess & Hoffmann, P.C.

(57) ABSTRACT

A method of constructing stained glass window systems is described. The stained glass window system includes a stained glass panel that includes a stained glass member joined to a seam member of a frame member with a joining material. A metal decorative silhouette is placed on one of the major surfaces of the stained glass panel and is joined thereto by applying a joining material to an aperture formed in the silhouette. In this manner, the silhouette obscures the seam member of the frame member. Optionally, a second silhouette may be joined to the opposing major face of the stained glass panel so that the design of the silhouette may be viewed from either side of the stained glass window. Additionally, the stained glass window system can be provided with at least one glass panel member, a peripheral frame member and peripheral insulation member.

34 Claims, 5 Drawing Sheets

DECORATIVE STAINED GLASS AND METHOD

CROSS-REFERENCE TO RELATED APPLICATIONS

This application claims the benefit of U.S. Provisional Application No. 60/288,962, filed May 4, 2001, the entire specification of which is expressly incorporated herein by reference.

FIELD OF THE INVENTION

The present invention relates generally to stained glass windows, and specifically to methods of combining stained glass, decorative metal, and insulated glass units.

BACKGROUND OF THE INVENTION

Stained glass windows have traditionally been made by cutting pieces of colored glass and skillfully fitting them together according to a pattern by using lead came, i.e. an H-shaped metal channel. Each individual piece of glass is cut by hand and meticulously fit to the pattern. The lead came is then soldered together at the joints to form an integral leaded glass window. The process is time consuming and very labor intensive.

This traditional methodology has not changed very much during the past several centuries. A window assembled as described above would typically then be cemented; that is, a cement compound developed for the purpose would be applied to the assembled window and brushed into the crevices between the cut pieces of glass and the lead came. The excess cement would then removed from the window surface. When the cement hardened, it would cause the leaded glass window to be substantially air and water tight, thus effectively sealing out wind and rain. However, the cement tends to become brittle over time. This is probably due to the exposure to the natural elements (e.g., sun, wind, rain, and so forth) and the cement eventually crumbles and falls out.

A recent advance in window construction that has helped significantly in this regard is "thermal" or insulated glass units (i.e., I.G.U.'s). An IGU typically consists of a leaded glass window that is sealed between two sheets of clear glass using a spacer and a peripheral seal (usually a polysulfide compound), thus obviating the need for cement. This type of I.G.U. is very commonly used today in architectural applications for residential use, office use as well as church windows and doors.

Another recent development is a filigree, i.e., a perforated metal design applied to a sheet of translucent or stained glass that has been used in "craft" items such as night-lights and lamp shades. However the design element of these items can only be viewed from one side.

Examples of several approaches to improving window-manufacturing techniques in general, and stained glass windows in particular, can be found with reference to the following patents, the entire specifications of which are expressly incorporated herein by reference. U.S. Pat. No. 6,272,801 to Suh discloses a method using plastic resin to simulate etched glass. U.S. Pat. No. 5,494,715 to Glover discloses tape inside an I.G.U. to simulate lead came. U.S. Pat. No. 5,352,532 to Kline discloses an injection mold process using plastic resin to simulate a textured clear/beveled glass decorative panel. U.S. Pat. No. 5,411,780 to Kaefer discloses the use of modular stained glass components, whereby an individual may compose his own colored glass window. Many approaches have attempted, by these and other methods, to reduce the tedious process of constructing stained glass windows by hand. However, they all lack, to a greater or lesser degree, the craftsmanship and quality that is required for traditional stained glass work.

Therefore, there exists a need for a method of constructing stained glass windows that is relatively efficient and cost-effective while at the same time being capable of producing a stained glass window that is exceedingly aesthetically pleasing as well as being sturdy and durable.

SUMMARY OF THE INVENTION

By using both the traditional and modern components of metal and glass, along with novel manufacturing technologies, the present invention has increased the efficiency of manufacture, while retaining the inherent beauty of handcrafted stained glass rather than attempting to merely simulate it. The present invention also has increased the amount of detail possible in the metal design component of a stained glass composition, while not substantially increasing the construction time, by using a specially designed metal silhouette. The present invention has further advanced the craft by designing the metal design component to be equally aesthetically pleasing when viewed from either of its two sides.

The present invention relates to a novel method of combining traditional stained glass with laser cut, acid-etched, or similarly produced metal silhouette design components. The stained (i.e., colored) glass panel preferably consists of pieces of stained glass cut to conform to a pattern, then preferably laid flat and joined edge to edge, either by fitting them into a metal H-channel came or wrapping the edges with an adhesive backed metal (copper) foil. This assembly is then preferably soldered together.

The decorative metal silhouette is then preferably superimposed onto the stained glass composition. Apertures in the silhouette preferably align with at least a portion of the exposed metal seams of the stained glass composition. Drops of molten solder are then preferably applied to affix the decorative metal silhouette to those points of the metal joints of the stained glass composition that are exposed through the silhouette's apertures. The seams of the individual pieces in the stained glass composition are thus substantially concealed by and/or incorporated into the design of the metal silhouette, depending on the specific design of the piece. The result is a composition in which a very intricate design replaces some or all of the "leadwork" in a traditional stained glass window, door, or similar type of framework.

In accordance with a first embodiment of the present invention, a method for forming a stained glass window system is provided, comprising: (1) providing at least one stained glass window assembly including at least one stained glass member joined to at least one seam member of at least one frame member with a first joining material, at least one decorative silhouette member having at least one aperture formed therein, the at least one decorative silhouette member positioned on a major surface of the at least one stained glass window assembly so as to substantially align the at least one aperture with the at least one seam member, and a sufficient amount of a second joining material applied to the at least one aperture so as to join the at least one stained glass member to the at least one decorative silhouette member, wherein the at least one decorative silhouette substantially obscures at least a portion of the at least one seam member; and (2) joining the at least one stained glass assembly to a structure.

In accordance with a second embodiment of the present invention, a method for forming a stained glass window system is provided, comprising: (1) providing at least one stained glass window assembly including at least one stained glass member joined to at least one seam member of at least one frame member with a first joining material; (2) providing at least one decorative silhouette member having at least one aperture formed therein; (3) positioning the at least one decorative silhouette member on a major surface of the at least one stained glass window assembly so as to substantially align the at least one aperture with the at least one seam member; and (4) applying a sufficient amount of a second joining material to the at least one aperture so as to join the at least one stained glass member to the at least one decorative silhouette member; wherein the at least one decorative silhouette substantially obscures at least a portion of the at least one seam member.

In accordance with a third embodiment of the present invention, a method for forming a stained glass window system is provided, comprising: (1) providing at least one stained glass member; (2) providing at least one frame member having at least one seam member; (3) positioning the at least one stained glass member within the frame member so as to abut the at least one seam member; (4) applying a sufficient amount of a first joining material to an area contiguous to the at least one seam member so as to join the at least one stained glass member to the at least one frame member to form a stained glass window assembly; (5) providing at least one decorative silhouette member having at least one aperture formed therein; (6) positioning the at least one decorative silhouette member on a major surface of the stained glass window assembly so as to substantially align the at least one aperture with the at least one seam member; and (7) applying a sufficient amount of a second joining material to the at least one aperture so as to join the at least one stained glass member to the at least one decorative silhouette member; wherein the at least one decorative silhouette substantially obscures at least a portion of the at least one seam member.

In accordance with a fourth embodiment of the present invention, a stained glass window system is provided, comprising: (1) at least one stained glass member; (2) at least one frame member having at least one seam member, the at least one stained glass member abutting the at least one seam member, the at least one stained glass member being joined to the at least one seam member with a first joining material; (3) at least one decorative silhouette member having at least one aperture formed therein, the at least one decorative silhouette member positioned on a major surface of the at least one stained glass window assembly so as to substantially align the at least one aperture with the at least one seam member; and (4) a sufficient amount of a second joining material applied to the at least one aperture so as to join the at least one stained glass member to the at least one decorative silhouette member; wherein the at least one decorative silhouette substantially obscures at least a portion of the at least one seam member.

Further objects and advantages are to provide a window that is easily cleaned by wiping only the outer panes of glass of the I.G.U., rather than having to clean each individual piece of glass as is typically necessary for a traditional un-insulated leaded glass window. By assembling the leaded glass panels using opaque or obscure glass, they will retain their decorative quality as well as provide an element of privacy. Either obscured or transparent, these windows may be used in either interior and/or exterior applications.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
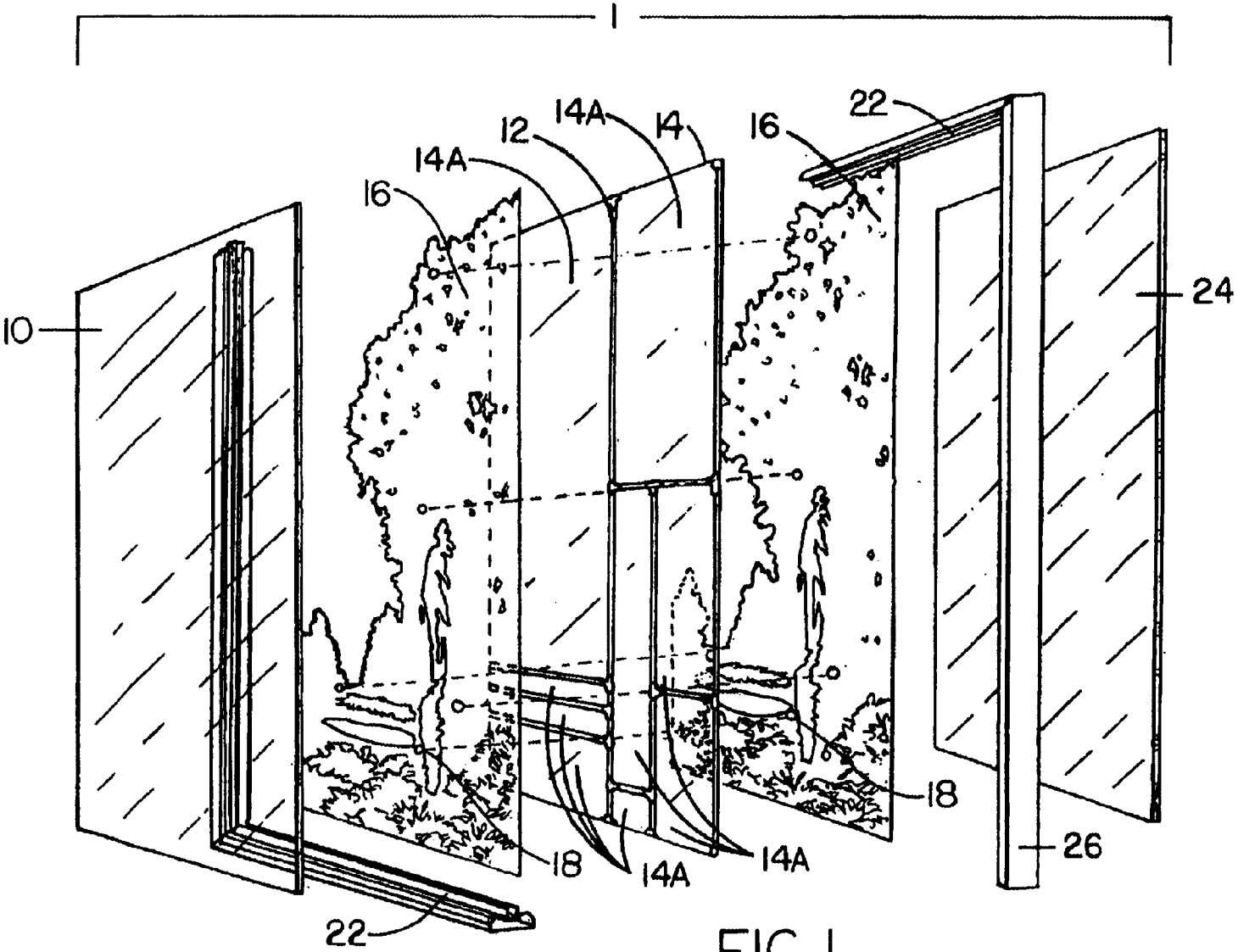
FIG. 1 illustrates an exploded view of at least some of the basic components of an exemplary decorative stained glass window, in accordance with the general teachings of the present invention. The subject matter in this example is a statue on a pedestal overlooking a reflecting pool.
Figure 2:
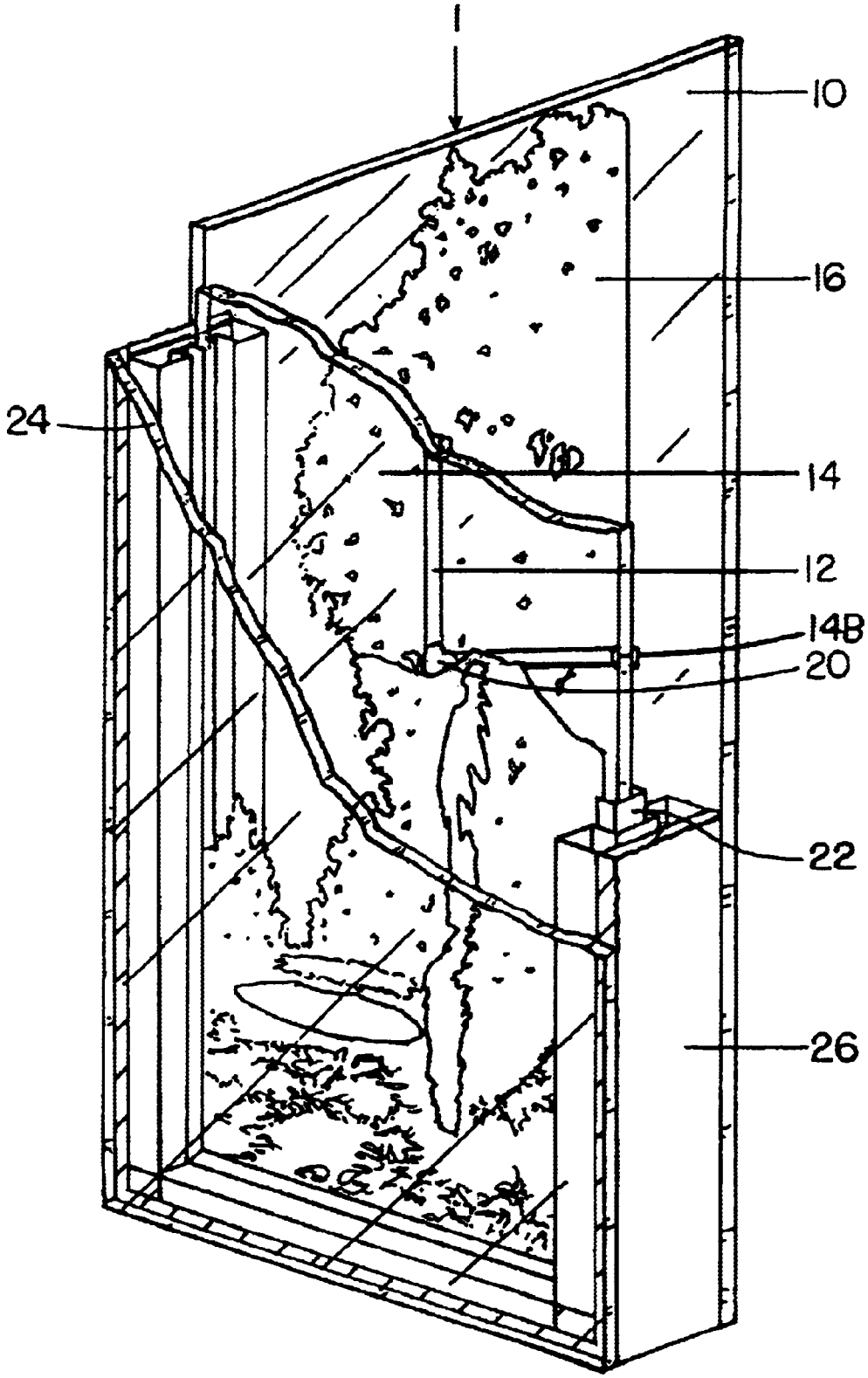
FIG. 2 illustrates a cross-sectional cut-away view of at least some of the basic components of an exemplary decorative stained glass window, in accordance with the general teachings of the present invention. In this example, the glass decorative metal, metal border channel, spacer, polysulfide/silicon/warm edge seal and outer panes of clear glass (I.G.U.'s) are shown.
Figure 4:
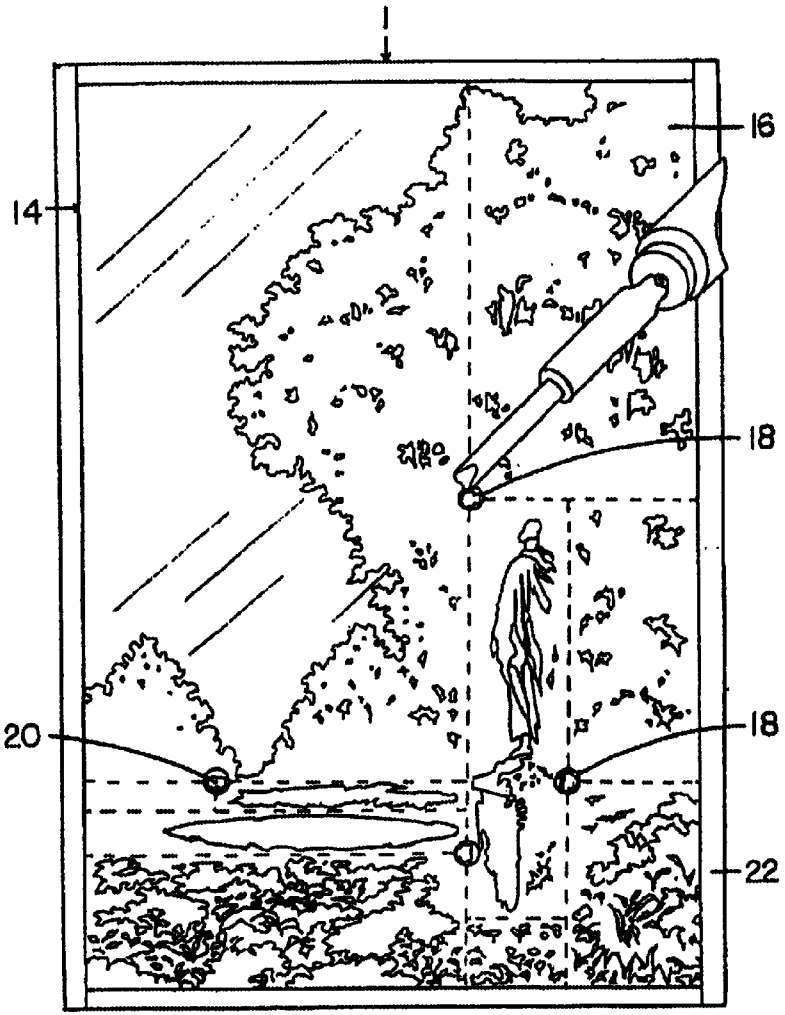
FIG. 4 illustrates an elevational view of the alignment of precut decorative metal silhouettes with a stained glass composition, in accordance with the general teachings of the present invention. Solder is being applied to the designated apertures in the silhouettes to join the metal to the glass composition.

The following description of the preferred embodiment is merely exemplary in nature and is in no way intended to limit the invention, its application, or uses.

With reference to the Figures generally, the various components and materials used in the present invention are designated by individual numerals as follows: a first clear glass pane or panel 10, a metal channel or came 12, an assembled stained glass composition 14, at least one stained glass piece 14*a*, at least one metal seam 14*b*, at least one decorative metal silhouette 16, at least one aperture formed in the metal silhouette 18, solder 20, at least one metal border channel 22, a second clear glass pane or panel 24, and a durable seal 26 (e.g., preferably a thermal seal comprised of polysulfide, silicon, and/or the like).

With reference to the Figures, there is shown an illustrative decorative stained glass window system or assembly 1, in accordance with a preferred embodiment of the present invention. At the center of the assembly 1 is a composition of stained (colored) glass 14, the individual pieces 14*a* are preferably laid flat and fit together, edge to edge using a metal H-channel came or adhesive-backed (copper) foil 12.

Figure 3:
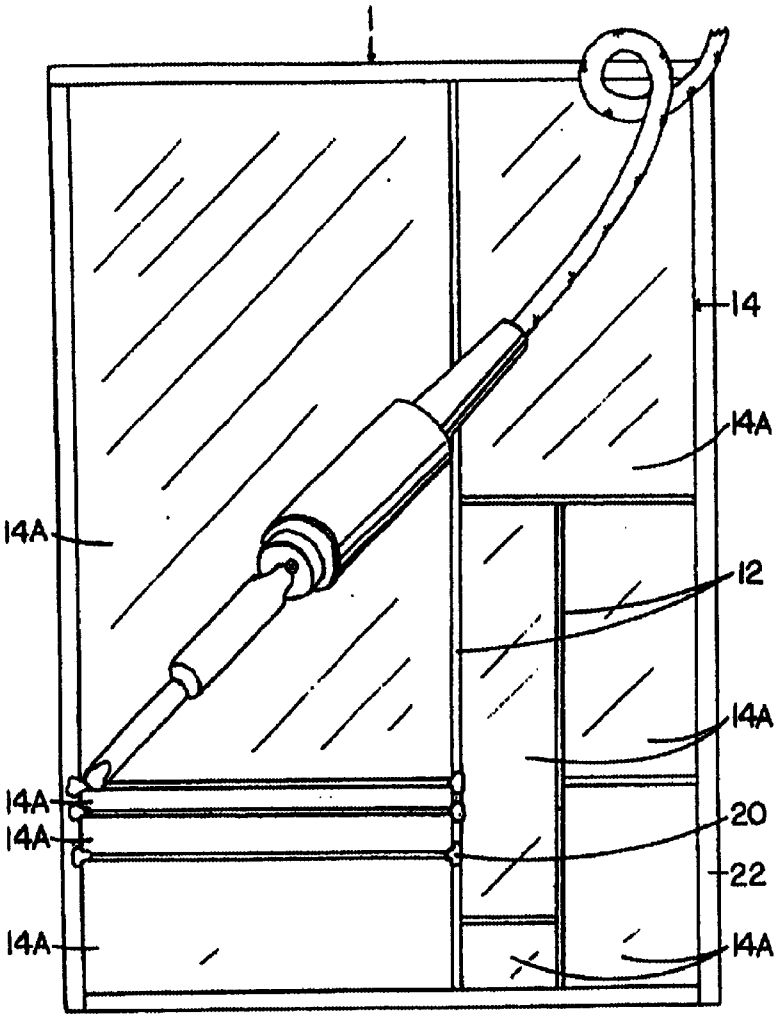
FIG. 3 illustrates an elevational view of cut pieces of stained glass being assembled using a metal H-channel came and being soldered together, in accordance with the general teachings of the present invention.

These pieces 14*a* are then preferably soldered together to form the one composite stained glass panel 14 made up of several (usually four to ten) pieces 14*a*, as specifically shown in FIG. 3.

By doing so, one piece of stained glass in the composition will represent, for example, the sky. The piece, as an example, might be blue, violet, and amber, i.e., three colors present in one piece of stained glass. Its neighboring piece may represent part of a landscape. Another neighboring piece may represent a pool or pond, or any number of other design elements.

Figure 6:
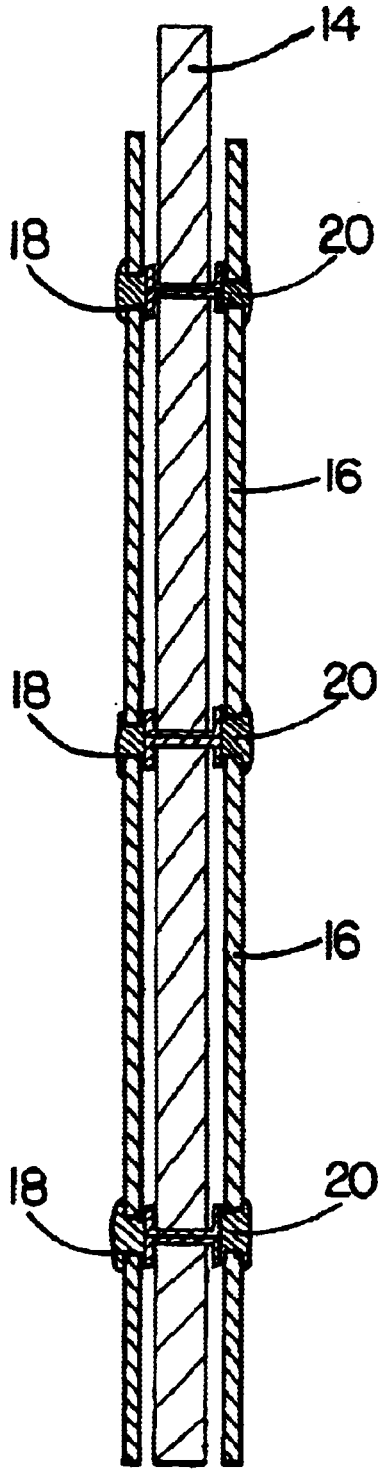
FIG. 6 illustrates a cross-sectional view of at least some of the basic components an exemplary decorative stained glass window, in accordance with the general teachings of the present invention.

Next, at least one and preferably two decorative metal silhouettes 16 (comprised of copper, brass, lead, and/or the like) are preferably aligned on either side of the stained glass panel 14. These relatively thin metal silhouettes 16 (e.g., approximately 0.04"–0.20" thick) may be laser cut, acid etched, CNC machined, punch press perforated, or made by other conventional production methods. Several specifically placed apertures 18 in the silhouettes 16 are designed to substantially coincide with, or align with, the exposed metal seams 14*b* of the stained glass composition described above. Drops of molten solder 20 are applied into the apertures 18 to quickly and permanently attach, affix or otherwise join the glass pieces 14*a* to the metal silhouettes 16. The silhouettes 16 are thus symmetrically secured to each side of the stained glass panel 14 as specifically shown in FIG. 6. It should be noted that the silhouettes 16 would preferably lie substantially flush against the major surfaces of the glass pieces 14*a* and that the air gaps shown in FIG. 6 are present for the ease of illustration only.

An important feature of the process of the present invention is that the seams 14*b* of the stained glass composition are concealed behind or otherwise obscured by the decorative metal silhouettes 16 whether viewed from either side or major surface thereof. The major part of the stained glass thus gives its color and character to the area of the composition for which it is designed and which the decorative metal silhouettes 16 complements. A metal border 22 is then preferably fitted to the perimeter of the stained glass panel 14 and decorative metal silhouettes 16 assembly. The entire assembly may then be treated with a chemical patina to oxidize the metal, turning it from shiny to dark, and giving it an antique (or verdigris) appearance.

At this point, the stained glass window assembly 1 may be considered a finished piece. However, it is preferable, to insulate the assembly in a thermal unit with clear glass panels 10 and 24 front and back, respectively, and a durable seal 26 formed around the perimeter thereof (i.e. to make it into an I.G.U.). Sealing the stained glass window assembly 1 within an I.G.U. makes it well suited to architectural applications, such as may be used in doors and windows for all building types.

Figure 5:
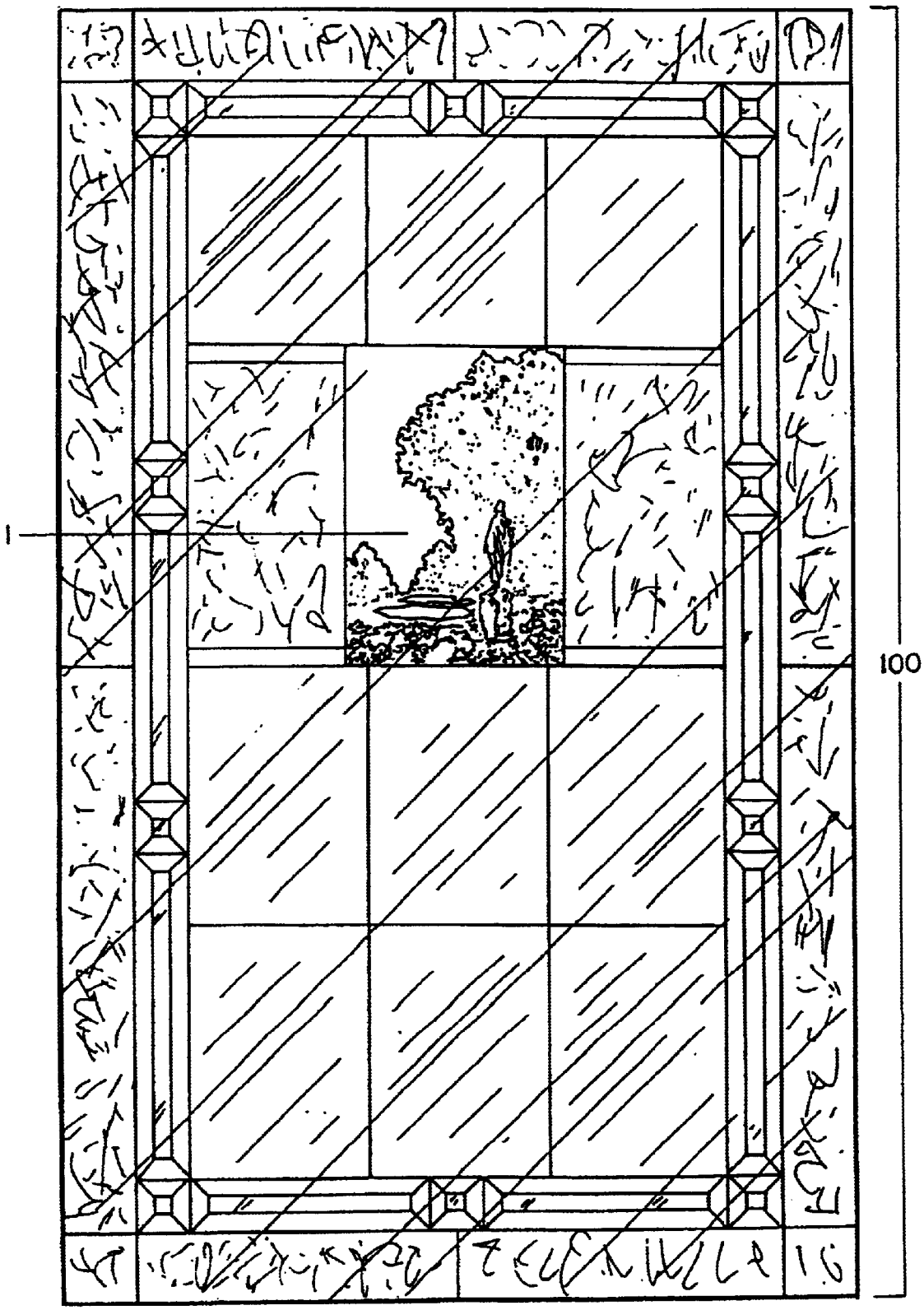
FIG. 5 illustrates an elevational view of an exemplary decorative stained glass window incorporated into a larger glass and metal window composition in a thermal insulated unit, in accordance with the general teachings of the present invention.

Alternatively, the stained glass window assembly 1 may also be incorporated into a larger leaded glass window or door-like composition 100, in conjunction with textured, clear, and/or beveled glass, as specifically shown in FIG. 5. The larger window composition 100 may then be sealed in a thermal unit, ready for installation in a door blank or window sash, for example. This latter application is the use to which the invention is particularly well suited for.

In addition to use in doors and windows, the stained glass window assembly 1 of the present invention may be used as signs for shops, as a wide variety of gift applications, desktop decorations, and souvenirs. Other uses could possibly include decoration within aquariums, kitchen cabinets and other furniture doors, canopies (e.g., skylights), conservatories, transom windows, even in mobile homes or automobiles.

The most readily available method of reducing cost and increasing ease of manufacture with respect to the present invention would be to substitute other materials for the metal and glass components. Specifically, plastic resins or similarly inexpensive materials could be used to simulate the colored glass and metal components. A plastic bonding agent could then be used instead of solder. Translucent colors may also be silkscreeened or otherwise transferred or printed onto a glass or plexiglass surface in place of the stained glass.

The combination of a stained glass composite panel and thin metal decorative silhouettes, joined together by solder "rivets" can be used to produce aesthetically pleasing stained glass windows while retaining a high degree of traditional or "Old World" charm. These can then be incorporated into larger lead glass panels.

The foregoing description of the invention is merely exemplary in nature and, thus, variations that do not depart from the gist of the invention are intended to be within the scope of the invention. Such variations are not to be regarded as a departure from the spirit and scope of the invention.

What is claimed is:

1. A method for forming a stained glass window system, comprising:

providing at least one stained glass window assembly including at least one stained glass member joined to at least one seam member of at least one frame member with a first joining material, at least one decorative silhouette member having at least one aperture formed therein, the at least one decorative silhouette member positioned on a major surface of the at least one stained glass window assembly so as to substantially align the at least one aperture with the at least one seam member, and a sufficient amount of a second joining material applied to the at least one aperture so as to join the at least one stained glass member to the at least one decorative silhouette member, wherein the at least one decorative silhouette substantially obscures at least a portion of the at least one seam member; and joining the at least one stained glass assembly to a structure.

2. The invention according to claim 1, wherein the at least one silhouette member is a substantially planar metallic member.

3. The invention according to claim 1, wherein the structure is selected from the group consisting of windows, doors, furniture, cabinetry, and combinations thereof.

4. The invention according to claim 1, further comprising positioning at least one glass panel member onto at least one of the major faces of the stained glass window assembly prior to joining the at least one stained glass assembly to a structure.

5. The invention according to claim 4, further comprising positioning at least one peripheral frame member around at least a portion of the periphery of the stained glass window assembly and the at least one glass panel member.

6. The invention according to claim 5, further comprising positioning at least one peripheral insulation member around at least a portion of the periphery of the peripheral frame member.

7. The invention according to claim 1, further comprising providing at least one other decorative silhouette member having at least one aperture formed therein, the at least one other decorative silhouette member positioned on an opposed major surface of the at least one stained glass window assembly so as to substantially align the at least one aperture with the at least one seam member, and a sufficient amount of a third joining material applied to the at least one aperture so as to join the at least one stained glass member to the at least one other decorative silhouette member, wherein the at least one other decorative silhouette substantially obscures at least a portion of the at least one seam member.

8. The invention according to claim 7, wherein the at least one other silhouette member is a substantially planar metallic member.

9. The invention according to claim 7, further comprising positioning at least one other glass panel member onto the at least one other major face of the stained glass window assembly prior to joining the at least one stained glass assembly to a structure.

10. The invention according to claim 9, further comprising positioning at least one peripheral frame member around at least a portion of the periphery of the stained glass window assembly and the at least one other glass panel member.

11. The invention according to claim 10, further comprising positioning at least one peripheral insulation member around at least a portion of the periphery of the peripheral frame member.

12. A method for forming a stained glass window system, comprising:

providing at least one stained glass window assembly including at least one stained glass member joined to at least one seam member of at least one frame member with a first joining material;

providing at least one decorative silhouette member having at least one aperture formed therein;

positioning the at least one decorative silhouette member on a major surface of the at least one stained glass window assembly so as to substantially align the at least one aperture with the at least one seam member; and applying a sufficient amount of a second joining material to the at least one aperture so as to join the at least one stained glass member to the at least one decorative silhouette member;

wherein the at least one decorative silhouette substantially obscures at least a portion of the at least one seam member.

13. The invention according to claim 12, wherein the at least one silhouette member is a substantially planar metallic member.

14. The invention according to claim 12, further comprising joining the stained glass window system to a structure selected from the group consisting of windows, doors, furniture, cabinetry, and combinations thereof.

15. The invention according to claim 12, further comprising positioning at least one glass panel member onto at least one of the major faces of the stained glass window system prior to joining the at least one stained glass system to a structure.

16. The invention according to claim 15, further comprising positioning at least one peripheral frame member around at least a portion of the periphery of the stained glass window system and the at least one glass panel member.

17. The invention according to claim 16, further comprising positioning at least one peripheral insulation member around at least a portion of the periphery of the peripheral frame member.

18. The invention according to claim 12, further comprising providing at least one other decorative silhouette member having at least one aperture formed therein, the at least one other decorative silhouette member positioned on an opposed major surface of the at least one stained glass window assembly so as to substantially align the at least one aperture with the at least one seam member, and a sufficient amount of a third joining material applied to the at least one aperture so as to join the at least one stained glass member to the at least one other decorative silhouette member, wherein the at least one other decorative silhouette substantially obscures at least a portion of the at least one seam member.

19. The invention according to claim 18, wherein the at least one other silhouette member is a substantially planar metallic member.

20. The invention according to claim 18, further comprising positioning at least one other glass panel member onto the at least one other major face of the stained glass window assembly prior to joining the at least one stained glass assembly to a structure.

21. The invention according to claim 20, further comprising positioning at least one peripheral frame member around at least a portion of the periphery of the stained glass window assembly and the at least one other glass panel member.

22. The invention according to claim 21, further comprising positioning at least one peripheral insulation member around at least a portion of the periphery of the peripheral frame member.

23. A method for forming a stained glass window system, comprising:

providing at least one stained glass member;

providing at least one frame member having at least one seam member;

positioning the at least one stained glass member within the frame member so as to abut the at least one seam member;

applying a sufficient amount of a first joining material to an area contiguous to the at least one seam member so as to join the at least one stained glass member to the at least one frame member to form a stained glass window assembly;

providing at least one decorative silhouette member having at least one aperture formed therein;

positioning the at least one decorative silhouette member on a major surface of the stained glass window assembly so as to substantially align the at least one aperture with the at least one seam member; and applying a sufficient amount of a second joining material to the at least one aperture so as to join the at least one stained glass member to the at least one decorative silhouette member;

wherein the at least one decorative silhouette substantially obscures at least a portion of the at least one seam member.

24. The invention according to claim 23, wherein the at least one silhouette member is a substantially planar metallic member.

25. The invention according to claim 23, further comprising joining the stained glass window system to a structure selected from the group consisting of windows, doors, furniture, cabinetry, and combinations thereof.

26. The invention according to claim 23, further comprising positioning at least one glass panel member onto at least one of the major faces of the stained glass window system prior to joining the at least one stained glass system to a structure.

27. The invention according to claim 26, further comprising positioning at least one peripheral frame member around at least a portion of the periphery of the stained glass window system and the at least one glass panel member.

28. The invention according to claim 27, further comprising positioning at least one peripheral insulation member around at least a portion of the periphery of the peripheral frame member.

29. The invention according to claim 23, further comprising providing at least one other decorative silhouette member having at least one aperture formed therein, the at least one other decorative silhouette member positioned on an opposed major surface of the at least one stained glass window assembly so as to substantially align the at least one aperture with the at least one seam member, and a sufficient amount of a third joining material applied to the at least one aperture so as to join the at least one stained glass member to the at least one other decorative silhouette member, wherein the at least one other decorative silhouette substantially obscures at least a portion of the at least one seam member.

30. The invention according to claim 29, wherein the at least one other silhouette member is a substantially planar metallic member.

31. The invention according to claim 29, further comprising positioning at least one other glass panel member onto the at least one other major face of the stained glass window assembly prior to joining the at least one stained glass assembly to a structure.

32. The invention according to claim 31, further comprising positioning at least one peripheral frame member around at least a portion of the periphery of the stained glass window assembly and the at least one other glass panel member.

33. The invention according to claim 32, further comprising positioning at least one peripheral insulation member around at least a portion of the periphery of the peripheral frame member.

34. A stained glass window system, comprising:

at least one stained glass member;

at least one frame member having at least one seam member, the at least one stained glass member abutting the at least one seam member, the at least one stained glass member being joined to the at least one seam member with a first joining material;

at least one decorative silhouette member having at least one aperture formed therein, the at least one decorative silhouette member positioned on a major surface of the at least one stained glass window assembly so as to substantially align the at least one aperture with the at least one seam member; and a sufficient amount of a second joining material applied to the at least one aperture so as to join the at least one stained glass member to the at least one decorative silhouette member;

wherein the at least one decorative silhouette substantially obscures at least a portion of the at least one seam member.

* * * * *